United States Patent [19]

Tanino

[11] Patent Number: 4,846,310

[45] Date of Patent: Jul. 11, 1989

[54] SIGNAL TRANSMISSION APPARATUS FOR ELEVATOR

[75] Inventor: Junichi Tanino, Inazawa, Japan

[73] Assignee: Mitsubishi Denki Kabushiki Kaisha, Japan

[21] Appl. No.: 192,347

[22] Filed: May 10, 1988

[30] Foreign Application Priority Data

May 12, 1987 [JP] Japan ..... 62-115119

[51] Int. Cl.[4] ..... B66B 3/00

[52] U.S. Cl. ..... 187/121; 187/133

[58] Field of Search ..... 187/121, 130, 133; 370/85, 86

[56] References Cited

U.S. PATENT DOCUMENTS

| | | | |
|---|---|---|---|
| 4,376,930 | 3/1983 | Sasao | 187/121 |
| 4,386,426 | 5/1983 | Pugh | 370/85 |
| 4,497,391 | 2/1985 | Mendelsohn et al. | 187/121 |
| 4,555,689 | 11/1985 | Brick et al. | 187/133 |
| 4,639,912 | 1/1987 | Tanino | 370/86 |
| 4,683,989 | 8/1987 | Pillage et al. | 187/121 |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A signal transmission apparatus for an elevator in a multi-story building comprises a small number of signal lines which carry, in a time-shared fashion, hall call signal and hall call registration information for all floors. On each floor, one or more signal terminal means comprises one or more push buttons for entering hall calls and one or more indicator lamps for indicating that a hall call has been registered. A reference signal originates in a control unit and propagates through a ring counter with stages corresponding to each signal terminal means and each separate direction of travel, ascending or descending, supported therein. A signal indicating that a button on a given signal terminal means has been pushed is transmitted over a hall call signal line in synchronization with the reference signal to the control unit. A hall call reference signal generated by the control unit is transmitted over a register line and is received by a signal terminal means to which it was transmitted in synchronization with the reference signal. Error detection and indication circuitry in each signal terminal means detects error conditions which could casue erroneous hall call signal information to be transmitted over the hall call signal line and provides a visual display to permit quick and easy isolation of which of the several data terminal means in the signal transmission system is causing the erroneous hall call signals.

10 Claims, 5 Drawing Sheets

SIGNAL TRANSMISSION APPARATUS FOR ELEVATOR

TECHNICAL FIELD

The present invention relates to an apparatus for transmitting signals produced when passengers push control buttons for an elevator to register hall calls for the floors at which they wish to enter the elevator car. More particularly, the invention relates to detection and indication of error conditions in the apparatus which result in erroneous registration of hall calls.

BACKGROUND ART

In a conventional elevator signal transmission system, each elevator stop, i.e., each floor, is equipped with one or more signal terminal means comprising control buttons and indicator lamps. A passenger pushes a control button to produce a hall call which identifies the floor at which the passenger wishes to enter an elevator car and the direction, up or down, the passengers wishes to go. A control unit registers the hall call and directs an elevator to proceed to the floor to pick up the passenger. An indicator lamp in the signal terminal means lights to indicate that the hall call has been registered. In systems where more than one signal terminal means is disposed on the floor, each corresponding indicator lamp in each signal terminal means lights to indicate that the hall call has been registered. At each floor, some of the control buttons and lamps are used for ascending purposes, while the remaining buttons and lamps are employed for descending purposes. The lowest floor has only lamps or buttons used for ascending purposes. Likewise, the uppermost floor has only lamps or buttons used for descending purposes.

Signals produced by the control buttons are typically processed with solenoid relays incorporated in the control unit, typically installed in a machine room on the roof of the building. One signal line and one relay are needed for each button. The control unit produces signals which drive the lamps. Each lamp requires one signal line. Therefore, if the building has n floors, as many as $4n-4$ signal lines are required to connect the control unit in the machine room with the lamps and buttons installed in the various signal terminal means at the floors. For this reason, the conventional system requires a large number of long signal lines for tall buildings.

In an attempt to reduce the number of signal lines needed, an improved signal transmission apparatus for an elevator has been proposed in, for example, Japanese Patent Laid-Open No. 69685/1983. In the improved system, each signal terminal means receives or transmits a given type of information over the same line in a time-shared fashion and in synchronization with a reference signal which authorizes one signal terminal means at a time to use the line. This proposed apparatus is now described by referring to FIGS. 1-3. A control unit 1 for an elevator comprising a microcomputer is installed in a machine room. The control unit 1 acts to produce clock pulses and reference signals. Also, the unit 1 calls the elevator car and registers the floors from which the elevator car is called. Signal lines 2 are connected to the control unit 1. The signal lines 2 are disposed in an elevator shaft, running the length of the shaft. Clock pulses 3*a* which are produced at given intervals, e.g., of 500 microseconds, are transmitted through a clock line 3. A hall call signal line 4 is used to convey a hall call signal 4*a* produced at a stop. A register line 5 is employed to transmit a hall call register signal 5*a*.

In FIGS. 1-3, an elevator signal transmission system in a nine-story building is depicted. For illustrative purposes, one signal terminal means 101-109 with one control button and one indicator lamp is shown per floor. It will be understood, however, that on each floor, other than the uppermost and lowest floors, each signal terminal means will have two buttons and two lamps for ascending and descending.

Memories, herein shown as D-type flip-flops 81-89, are installed at ninth through first floors, respectively, and together make up a ring counter. This is a flip-flop corresponding to each signal terminal means for each direction of travel. Since each signal terminal means shown in FIG. 2 has one button and one lamp, there is one flip-flop corresponding to each signal terminal means. If a signal terminal means had two buttons and two lamps to support both ascending and descending, two flip-flops would correspond to the signal terminal means, one for each direction. Each signal terminal means is connected to receive reference signals from the flip-flop or flip-flops corresponding thereto.

To provide a clock signal to the flip-flops 81-89, the terminal CL of each flip-flop 81-89 is connected to the clock line 3. A reference line 91 connects the control unit 1 with a D input of the flip-flop 81. The control unit 1 transmits over the reference line 91 a reference signal 91*a*, illustrated in FIG. 3. The reference signal 91*a*, normally in a logical low state, makes a transition to a logical high state. The signal 91*a* remains in the high state for one cycle of the clock 3*a* plus a short additional delay and then returns to the logical low state. Reference lines 92-99, running between adjacent floors, connect respective Q outputs and D inputs of flip-flops 82-89 as shown in FIG. 2. As the flip-flops 81-89 receive successive clock pulses 3*a*, each of the flip-flops 81-89 making up the ring counter in turn outputs high reference signals 91*a*-99*a*, as shown in FIG. 3. Thus, each signal terminal means, in turn, receives a high logical state reference signal. To permit a given signal terminal means to use a line undisturbed by other signal terminal means, components of signal terminal means may be enabled by the reference signal. Components of the signal terminal means 101-109 which are enabled by the reference signals 91*a*-99*a* are said to operate in synchronization with the reference signals 91*a*-99*a*. Since only one signal terminal means at a time has a high reference signal, synchronization with the reference signal permits data transfers to or from a desired signal terminal means over the register line 5 and the hall call signal line 4 even though the lines 4, 5 are common to all signal terminal means.

To permit passengers to enter hall calls, control buttons 61-69 are provided in the signal terminal means 101-109. To sequentially enable hall calls onto the hall call signal line 4 in synchronization with the reference signals 91*a*-99*a*, logic devices, herein shown as AND gates 121-129, have first inputs connected to the reference lines 91-99, respectively, and second inputs connected to the control buttons 61-69, respectively. The outputs of the AND gates 121-129 are connected with the hall call signal line 4.

Indicator lamps 71-79 light to indicate registered hall calls. To hold registered hall calls and drive the lamps 71-79, Q outputs of D-type flip-flops 111-119 are connected to the lamps 71-79. To latch registered hall calls into the flip-flops 111–119 in synchronization with the reference signals 91a–99a, the terminals CL of the flip-flops 111–119 are coupled to the terminals Q of the flip-flops 81–89, respectively. The registered hall calls are provided from the control unit 1 as the hall call register signal 5a over the register line 5 to D inputs of the flip-flops 111-119.

If, for example, the button 62 at the second floor is pressed, the output of the AND gate 122 will rise in synchronization with next-occurring reference signal 92a. The output of the AND gate 122 is conveyed as the hall call signal 4a to the control unit 1 through the signal line 4. If the button 63 at the stop for the third floor is pressed, the output from the AND gate 123 rises in synchronization with the next-occurring reference signal 93a. The output of the AND gate 123 is transmitted as the hall call signal 4a over the same signal line 4. If the two buttons 62 and 63 are depressed simultaneously, the call signals 4a are conveyed in succession over the same call signal line 4, as illustrated in FIG. 3. These operations are repeated, in turn, to obtain the state dictated by one or more of the buttons 61–69. After a given number of clock pulses 3a are sent out, all the data is collected. These signals are processed by the control unit 1 and registered as hall call signals.

The hall call register signal 5a is transmitted from the control unit 1 through the registration line 5 to the input to the terminal D of the flip-flops 111–119. The hall call register signal 5a is synchronized with the reference signal 91a so that, when the reference signal for a given flip-flop 81–89 of the ring counter is clocked high, the registration line 5 will at that moment be carrying the hall call register signal for the respective signal terminal means 101–109. The output of the ring counter flip-flop 81–89 clocks the hall call register signal into the latch flip-flop 111–119. The high output of the latch flip-flop 111–119 then lights the lamp 71–79, indicating that the hall call has been registered.

In this conventional elevator signal transmission apparatus using time-shared signal lines, only the four signal lines 3–5 and 91 are needed to connect the signal terminal means 101–109 to the control unit 1. The number of signal lines is independent of the number of floors and the number of signal terminal means per floor, so this apparatus is especially suited for tall buildings with many floors.

A problem can arise if a signal terminal means outputs a hall call signal out of synchronization with the reference signal. If the circuit connected to the output of the AND gate 121 is short-circuited, for example, the hall call signal 4a is maintained high. A continuous high hall call signal 4a is interpreted by the control unit 1 as simultaneous, continuous hall calls from all floors. If such a problem occurs, the elevator car stops at every floor. Hence, service is undesirably slow. This type of problem is difficult to repair quickly because there is no easy way to tell which signal terminal means has the short-circuit. Each serial terminal means 101–109 must be checked separately for short-circuits until the defective serial terminal means is found.

DISCLOSURE OF THE INVENTION

The object of the present invention is to overcome the need for time-consuming checking to identify a faulty circuit in one of a plurality of signal terminal means by providing a signal transmission apparatus for use with an elevator including an apparatus for detecting and indicating error conditions.

A further object of the invention is to permit a repairman to quickly discover which of several signal terminal means connected to a common signal line contains a faulty circuit, whereby the elevator can be repaired in a shorter time than can an elevator employing a conventional signal transmission apparatus.

BEST MODE FOR CARRYING OUT THE INVENTION

While the invention will be described in connection with a preferred embodiment illustrated in FIG. 4, it will be understood that it is not limited to that embodiment. On the contrary, the invention is intended to cover all alternatives, modifications, and equivalents as may be included within the spirit and scope of the invention as defined by the appended claims.

Figure 1:
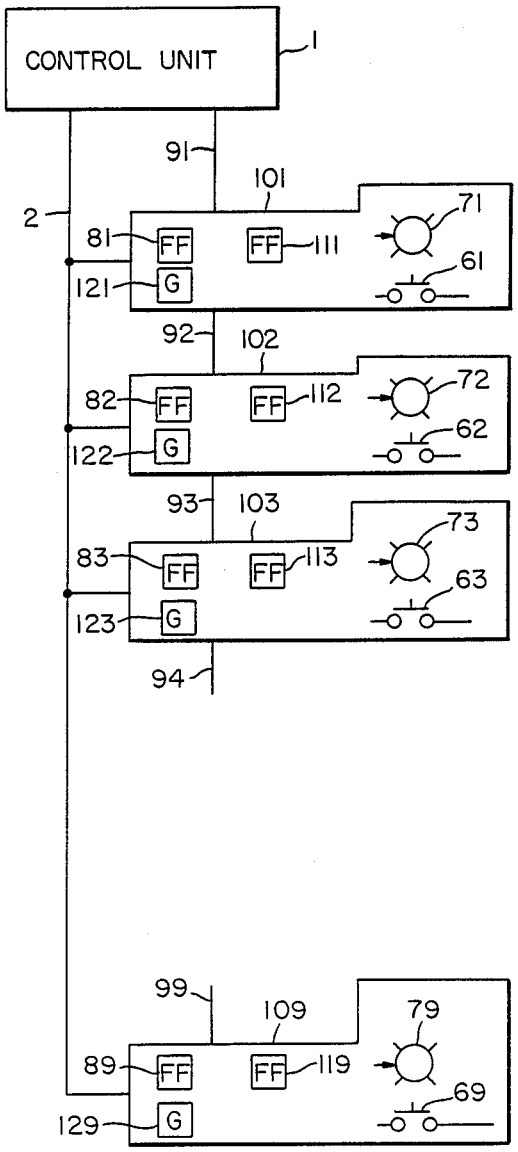
FIG. 1 is a schematic block diagram of a conventional signal transmission apparatus for an elevator.
Figure 2:
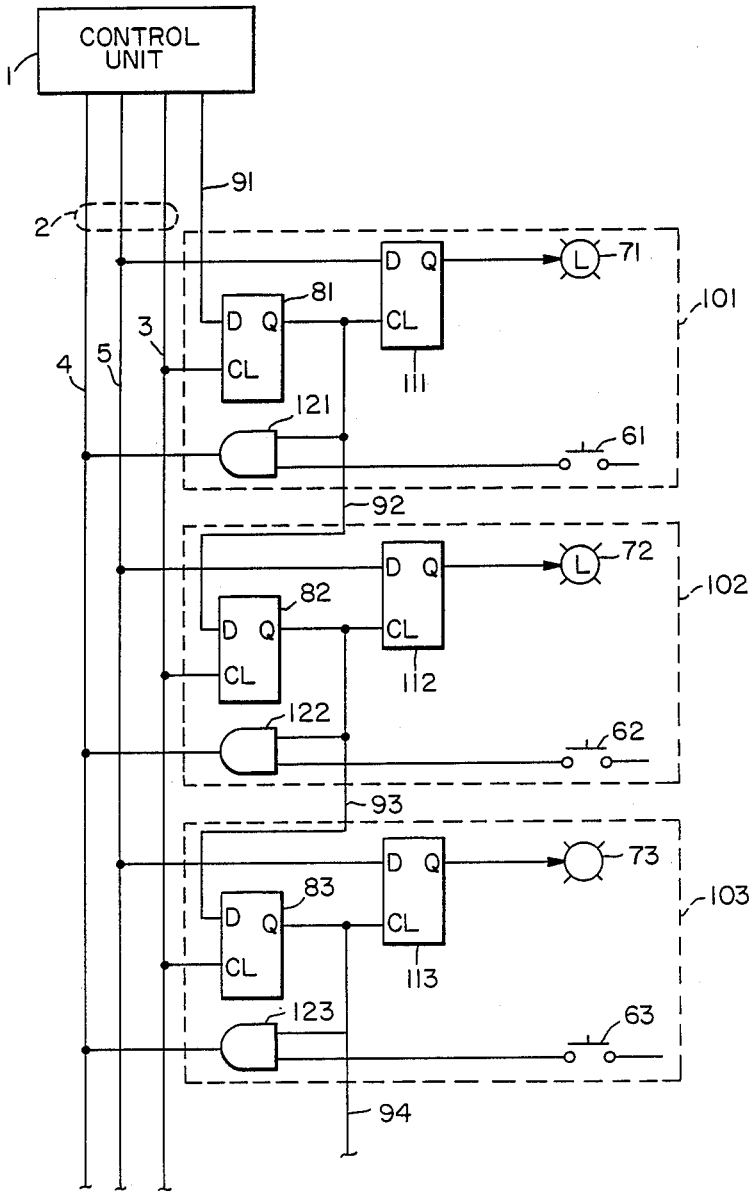
FIG. 2 is a circuit diagram of a part of the apparatus shown in FIG. 1.
Figure 3:
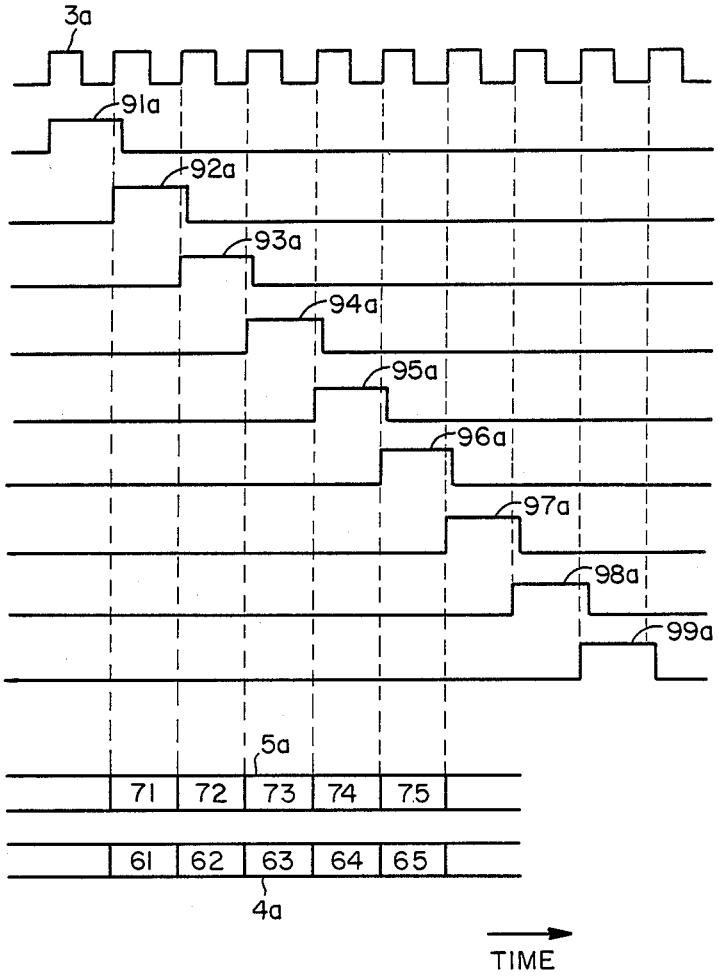
FIG. 3 is a timing diagram for illustrating the operation of the apparatus shown in FIG. 1.
Figure 4:
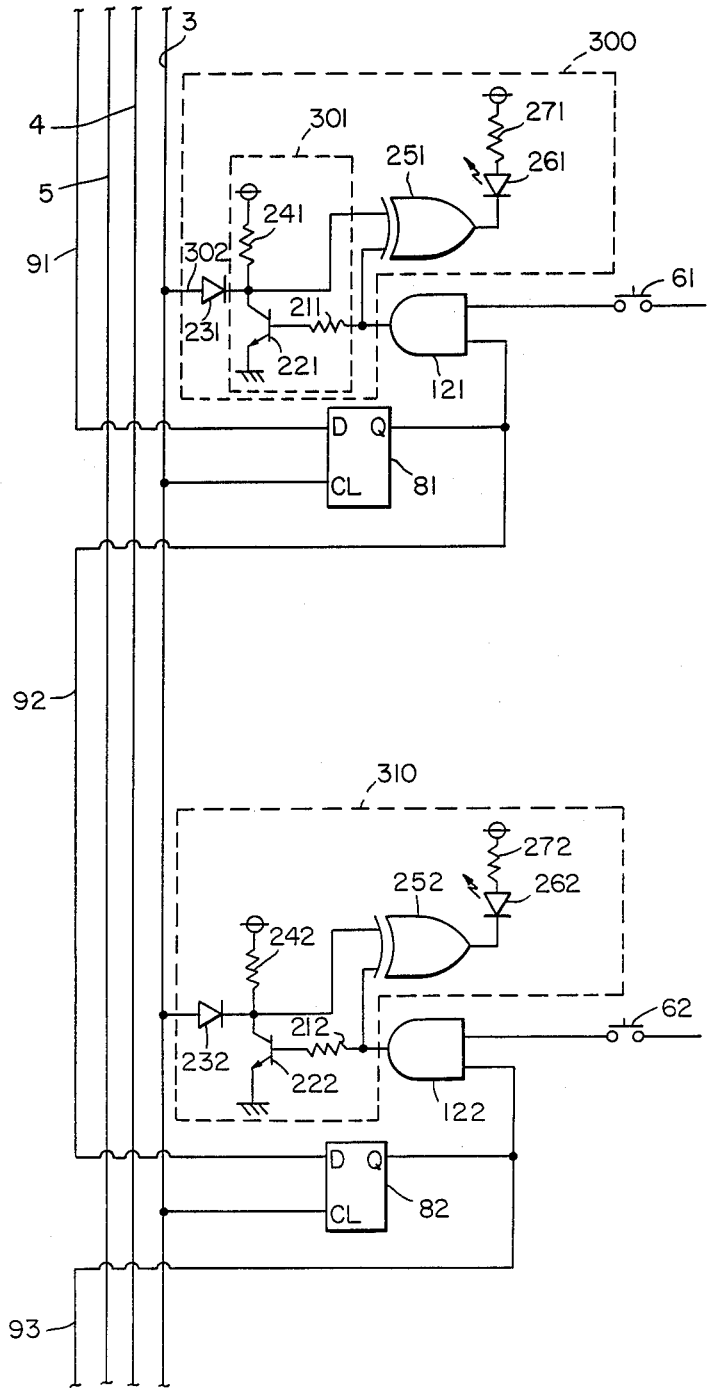
FIG. 4 circuit diagram of an apparatus according to the invention.

FIG. 4 shows a configuration encompassing some of the components of the prior art system disclosed in FIG. 2 along with a preferred embodiment of the invention. Like components are indicated by like numerals in FIGS. 2 and 4. Specifically, the hall call signal line 4 and the AND gates 121, 122 shown in FIG. 4 are identical to those in FIG. 2. FIG. 4 also shows an error detecting and indicating circuit 300 as an embodiment of the invention. It is to be understood that a circuit 310 is identical to the circuit 300 and that each signal terminal means 101–109 is modified in similar fashion in accordance with the invention to include an error detecting and indicating circuit such as the circuit 300 of the present embodiment.

To detect error conditions in the hall call signal transmitted onto the hall call signal line 4 resulting from a high short-circuit condition on the line connecting the signal terminal means 101 to the hall call signal line 4, the circuit 300 is positioned between the output of the AND gate 121 and the hall call signal line 4. The circuit 300 comprises an inverter circuit 301 for producing a signal which is the logical inversion of the output of the AND gate 121 and for transmitting the inverted hall call signal through the diode 231 onto the hall call signal line 4. To provide non-inverted hall call signals from the hall call signal line 4 to the control unit 1, an inverter circuit (not shown) is added as an input stage to the control unit 1.

In accordance with the invention, the disclosed embodiment shows an inverter circuit comprises an NPN transistor 221. In order for the output signal for the gate 121 to provide base drive for the transistor 221, the base of the transistor 221 is connected via a resistor 211 to the output terminal of the AND gate 121. To provide power to the transistor 221, its collector is connected to the positive terminal of a DC power supply via a resistor 241, and its emitter is grounded. To isolate the inverter circuit from the hall call signal line 4 while other signal terminal means 102–109 are driving the line 4, a cathode of a diode 231 is connected with the collector of the transistor 221, while an anode of the diode 231 is connected to a line 302 connected to the hall call signal line 4.

In normal operation, a high output of the AND gate will provide base drive to the transistor 221. Consequently, collector current will be drawn into the collector through the resistor 241. The resulting voltage drop across the resistor 241 will bring the collector of the transistor 221 to a low voltage representing a low logical state. Likewise, a low output of the AND gate will not provide base drive to the transistor 221. Consequently, no collector current will be drawn through the resistor 241, and the collector of the transistor will reach a high voltage representing a high logical state. Thus, in normal operation, the output of the AND gate 121 and the collector of the transistor 221 will always be in opposite logical states.

If the diode 231 or the transistor 221 included in the final stage for sending out signals to the hall call signal line 4 is short-circuited, then the collector of the transistor 221 remains at a low voltage and logical state regardless of the output of the AND gate 121. The low voltage of the collector pulls the hall call signal line 4 low even during periods when the other signal terminal means 102–109 are synchronized with the reference signals **92*a*–99*a*. During such periods, the output of the AND gate 121 will normally be low. Consequently, both the collector of the transistor 221 and the output of the AND gate 121 will be in the same logical state. Similarly, if the line 302 is shorted high, the collector of the transistor 221 will remain high even when the output of the AND gate 121 is high. Likewise, the output of the AND gate 121 and the collector of the transistor 221** will both be in the same logical state.

The inverter circuit 301 provides a means for detecting the above-described short circuits. The error conditions resulting from the short-circuits have in common the fact that the output of the AND gate 121 and the collector of the transistor 221 are both in the same logical state. To detect this error condition, an EXCLUSIVE-OR gate 251 has a first input terminal connected with the output terminal of the AND gate 121 and a second input terminal connected with the collector of the transistor 221. The EXCLUSIVE-OR gate 251 detects identical logical states by outputting a low signal. To provide a visual indication of the detected error, a cathode of a light emitting diode (LED) 261 is connected to the output of the EXCLUSIVE-OR gate 251. An anode of the LED is connected to the positive terminal of a DC power supply via a resistor 271. The EXCLUSIVE-OR gate 251, the LED 261, and the resistor 271 constitute an error-detecting means.

In normal operation, as stated above, the output of the AND gate 121 and the collector of the transistor 221 are in opposite logical states. These two signals are input to the exclusive EXCLUSIVE-OR gate 251. As a result, the output of the EXCLUSIVE-OR gate 251 is normally high. Thus, the LED 261 is not forward-biased so it does not emit light. In the aforementioned error conditions, the EXCLUSIVE-OR gate 251 outputs a low signal. Under these conditions, the LED 261 is forward-biased so that it conducts current and emits light. The illuminated LED 261 provides quick and easy identification of the faulty circuit.

In accordance with the invention, if one of several signal terminal means contains a defective circuit, causing erroneous hall call signals to appear on the hall call signal line, the defective circuit may be readily identified as the one with the lighted LED. If LEDs 261–269 are installed on the sides of the elevator shaft at the respective floors, then the defective circuit may be located by moving the elevator car through the shaft while watching for a lighted LED. Hence, the defective circuit can be quite easily discovered and repaired or replaced in a very short time.

Defective circuit components may be in an open state rather than short-circuited. If a component of a signal terminal means is in the open state, then it is impossible to call the elevator car at the respective floor. Accordingly, this fault can be easily found by depressing the control buttons at the floors and observing whether the indicator lamps light.

Figure 5:
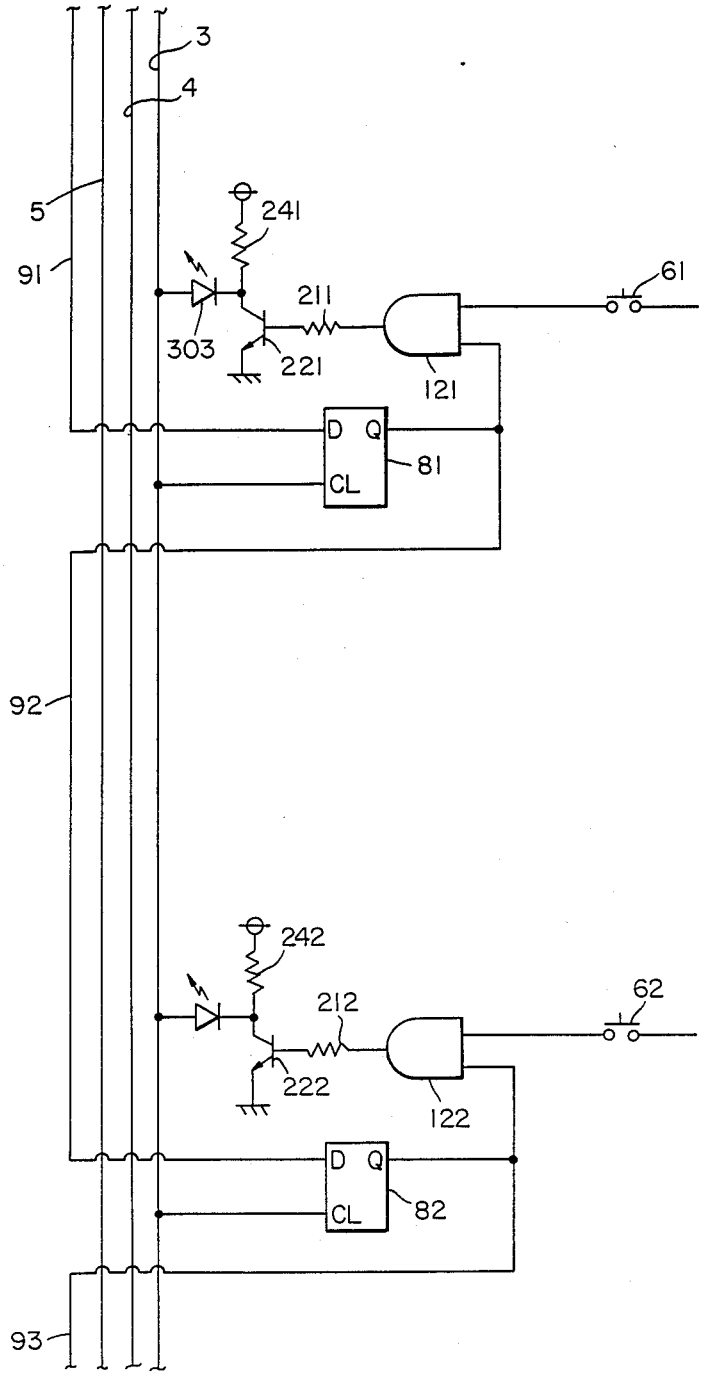
FIG. 5 is a circuit diagram of an alternative apparatus embodiment of the invention.

In the embodiment of FIG. 4, the diode 231 is provided to assure detection of a short-circuit of the transistor 221. If either of the devices are short-circuited, then a defective device can be found by observing the LED. In an alternative embodiment illustrated in FIG. 5, the circuit consisting of the EXCLUSIVE-OR gate 251, the LED 261, and the resistor 271 is omitted, and an LED 303 is connected instead of the diode 231. If the transistor 221 is short-circuited, it can be detected in the same manner as in the above example although the low level on the signal line 4 rises compared with the case where the diode is used, thus reducing the noise margin.

In this alternative embodiment, under normal operation the LED 303 may be lighted for a short time by a signal transmitted from a different signal terminal means in a time-shared manner. This brief period of illumination may not be noticed by an observer. If the transistor is short-circuited, however, then the diode emits light continuously, thus permitting easy observation of the illuminated LED 303. As in the embodiment of FIG. 4, the circuit connected to the output of each AND gate inverts the output of the AND gate by means of the transistor.

In summary, error conditions can be detected in the same manner in another alternative embodiment by the use of a switching device other than a transistor. In accordance with the invention, a hall call signal is sent to the common signal line after being inverted by an inverter circuit. A diode prevents hall call signals produced at other stops from being conveyed from the hall call signal line 4 to the output terminal of the inverter circuit. Only when any circuit component of the output stage is short-circuited does the level of the input to the inverter become equal to the level of the output from the inverter circuit. Therefore, it may be easily observed which of several circuits connected to the common signal line is at fault. As a result, repairs to the elevator can be made in a much shorter time than heretofore.

I claim:

1. A signal transmission apparatus for an elevator comprising:

a control unit which produces reference signals;

a plurality of signal terminal means installed at floors where the elevator stops and admits passengers;

signal lines connecting said control unit and said plurality of signal terminal means, said signal lines comprising:

a reference line connected to transmit the reference signal, a hall call signal line, and a hall call register line; and a ring counter with a data input connected to the reference line and a clock input connected to the clock line comprising a plurality of memory devices corresponding, respectively, to the plurality of signal terminal means, each memory device having a data output connected to a respective signal terminal means;

each signal terminal means comprising:

a control button connected to produce, when depressed, a hall call signal;

a logic device with first and second inputs connected to receive, respectively, the hall call signal and the reference signal and produce a first output signal in a first logical state;

an inverter circuit connected to receive the first output signal and produce a second output signal in a second logical state that is the opposite of the first logical state;

a diode with a cathode connected to receive the second output signal and an anode connected to the hall call signal line; and error-detecting means for sensing an error condition that the first and second output signals are in the same logical state and for providing an indication of the sensed error condition.

2. The signal transmission apparatus of claim 1 wherein each inverter circuit comprises a transistor.

3. The signal transmission apparatus of claim 2 wherein each transistor is an NPN transistor with a base connected with the output terminal of the logic device, a collector connected with a DC power supply, and an emitter grounded.

4. The signal transmission apparatus of claim 1 wherein an anode of the diode is connected with the call signal line and wherein a cathode of the diode is connected to receive the second output signal.

5. The signal transmission apparatus of claim 1 wherein said error-detecting means comprises a light emitting diode.

6. The signal transmission apparatus of claim 5 wherein said error-detecting means further comprises an EXCLUSIVE-OR gate with a first and a second input terminal connected, respectively, to receive the first and second output signals, and an output terminal connected with a cathode of the light emitting diode.

7. The signal transmission apparatus of claim 1 wherein said memory comprises a D-type flip-flop.

8. The signal transmission apparatus of claim 1 further comprising:

a latch with a data input connected to the hall call registrater line, a clock input connected to the data output of the respective memory device, and a data output; and a hall call registration lamp connected to the latch data output.

9. A signal transmission apparatus comprising:

control means for sending and receiving data, and sending a reference signal;

signal lines connected to carry the data, and the reference signal; and a plurality of signal terminal means connected to the signal lines, each signal terminal means comprising:

a memory means for storing the reference signal;

monitor means for monitoring hall calls, producing hall call data, and transmitting the hall call data on a first data signal line in synchronization with the reference signal;

hall call registration means for receiving data about registered car calls on a second data signal line in synchronization with the reference signal and for displaying the registered hall call data;

error-detecting means for detecting error conditions between the monitor means and the first data signal line; and error display means for indicating that said error-detecting means detected an error condition.

10. A signal transmission apparatus comprising:

a control unit connected to receive and transmit serial data over transmission lines;

a plurality of terminals connected to receive and transmit serial data over the transmission lines, each terminal comprising:

a push button;

a logic device connected to detect when the push button is depressed and connected to transmit data onto a first transmission line;

a memory device for receiving data from a second transmission line;

a first display connected to receive data from said memory device to be displayed;

an error-detecting circuit connected to the output of said logic device; and a second display device connected to an output of said error-detecting circuit.

* * * * *